US006349574B1

(12) United States Patent
Lurie

(10) Patent No.: US 6,349,574 B1
(45) Date of Patent: Feb. 26, 2002

(54) HIGH SECURITY-RESTRICTED KEY RETROFIT KIT FOR HANDCUFFS AND LEG IRONS

(76) Inventor: Alan E. Lurie, 52 Briarwood Dr., Huntington, NY (US) 11743

( * ) Notice: Subject to any disclaimer, the term of this patent is extended or adjusted under 35 U.S.C. 154(b) by 0 days.

(21) Appl. No.: 09/635,498

(22) Filed: Aug. 9, 2000

Related U.S. Application Data

(60) Provisional application No. 60/148,113, filed on Aug. 10, 1999.

(51) Int. Cl.[7] ..... E05B 75/00
(52) U.S. Cl. ..... 70/16; 70/DIG. 63
(58) Field of Search ..... 70/15–18, DIG. 63

(56) References Cited

U.S. PATENT DOCUMENTS

| | | | | | |
|---|---|---|---|---|---|
| 985,560 | A | * | 2/1911 | Widmayer | 70/16 |
| 1,845,511 | A | | 2/1932 | Neal | 70/16 |
| 1,851,207 | A | * | 3/1932 | Neal | 70/16 |
| 3,392,554 | A | | 7/1968 | Williamson | 70/16 |
| 3,616,665 | A | | 11/1971 | Rosenthal | 70/16 |
| 4,574,600 | A | | 3/1986 | Moffett | 70/16 |
| 5,007,257 | A | | 4/1991 | Thompson | 70/16 |
| 5,138,852 | A | | 8/1992 | Corcoran | 70/16 |
| 5,526,658 | A | * | 6/1996 | Cross et al. | 70/16 |
| 5,797,284 | A | | 8/1998 | Lurie | 70/16 |

* cited by examiner

*Primary Examiner*—Lloyd A. Gall
(74) *Attorney, Agent, or Firm*—Darby & Darby

(57) ABSTRACT

A device to be attached to a handcuff or leg iron that disables the existing key that is used to lock and unlock the handcuff or leg iron and replaces it with a locking mechanism that utilizes a non-universal key. The locking mechanism is preferably parallel to the pivot access of the handcuff locking arm and its keyway is spaced above the cheek plates of the body of the handcuff or leg iron and therefore is more difficult to access by the prisoner. The locking mechanism is set by insertion of a key into the same keyway, in a ready to lock position in which the handcuff or leg iron can be tightened but not loosened, or in a triple locked position in which the handcuff or leg iron cannot be tightened or loosened. This triple lock is in addition to the double lock position that is typically offered by the original handcuff or leg iron. The locking mechanism of the device can be removed and re-keyed and is of a pick resistant type and the keys are available only to authorized users; they are not available to the general public.

10 Claims, 3 Drawing Sheets

HIGH SECURITY-RESTRICTED KEY RETROFIT KIT FOR HANDCUFFS AND LEG IRONS

"This patent application claims the priority of U.S. provisional patent application No. 60/148,113, which is incorporated herein by reference filing date Aug. 10, 1999."

FIELD OF THE INVENTION

The present invention relates to a handcuff accessory having an improved locking mechanism. More particularly, the invention relates to a handcuff accessory having a lock, preferably a cylinder lock, that is formed and positioned in a manner such that it is more difficult to pick by a prisoner or another individual. The accessory, preferably provided in the form of a retrofit kit, which can be installed onto existing handcuffs and leg irons.

BACKGROUND OF THE INVENTION

Handcuffs and leg irons are generally formed with a lock body housing having planar, parallel cheek plates and a C-shaped extension to which a locking arm is pivotally connected. The locking arm typically has a free end with a series of ratchet teeth that interlock with teeth on a pawl located between the cheeks of the lock body housing. A locking mechanism is provided for locking the pawl, thereby locking the arm once engaged in between the cheeks.

Most handcuffs and leg irons have more than one locking position. The first locking position may be referred to as the "ready to lock" position. In this position, the locking arm is permitted to continue to tighten around the prisoner's wrist or ankle in one direction only and cannot be loosened. This is because the pawl, in the "ready to lock" position is being kept under pressure by a spring, causing the pawl to snap back down as the locking arm is cycled through the cheeks from tooth to tooth. This produces an opposing and interlocking connection between the teeth on both the pawl and the locking arm of the handcuffs and leg irons. In the "ready to lock" position, the locking arm is never permitted to move backwards in or from the housing so as to loosen the handcuffs or leg irons.

The second locking position on handcuffs and leg irons may be referred to as the "double lock" position. In this position, the handcuff locking arm cannot be moved forward or backward because the pawl is securely engaged with the locking arm and cannot be moved at all.

Prior art handcuffs usually have a locking device that uses a key. The key basically is a piece of metal that is used to move the pawl in order to disengage the locking arm. A paper clip, or similar piece, often can be formed to accomplish the same task. The lock of prior art handcuffs also has a keyway that is relatively easy for the prisoner to access. The keys used on most handcuffs are generally manufactured as "universal" keys. That is, one key will operate a number of handcuffs or leg irons. Such universal keys are widely available from many sources and there is no restriction as to whom they are sold. Accordingly, a prisoner and/or accomplice possibly can obtain or make a key, thereby facilitating the possibility of an escape.

An exception to the above is shown in U.S. Pat. No. 5,797,284 to Lurie. Here, the locking device is a high security cylinder, and there is restricted access to the keys and a keyway that is moved to above the plane of the handcuffs.

In order to prevent escapes facilitated by the use of a "universal" key, handcuffs also have been designed with cylinder locks having multiple tumblers, such as shown in U.S. Pat. No. 3,392,554 to Williamson. The key that opens such a lock must be specifically designed for that lock. Accordingly, a standard, "universal" key will not open such a lock, making procurement of a key to unlock the handcuffs or leg irons more difficult. However, once the original key is obtained by an unauthorized person, duplicates can be made. In addition, such locks are positioned and oriented in the handcuffs and leg irons in such a way that it is easy for the prisoner to obtain access to the keyway.

The first and second locking mechanisms of the double locking mechanism of the above-mentioned U.S. Pat. No. 3,392,554 are each engaged in a similar manner (i.e., by insertion of the same key into the same keyway). It is not difficult to engage the two locking mechanisms of the double locking mechanism of this patent. Thus, it has the disadvantage of being too easy to activate. Specifically, the first and second locking positions are engaged by rotating a lock plug without the need for inserting a key into the lock plug. Accordingly, it is not difficult for the lock to inadvertently slip into the double lock position.

The double locking mechanisms such as shown in above-mentioned U.S. Pat. No. 4,574,600 and also in U.S. Pat. No. 1,845,511 to Neal, generally use a "universal" key. These prior art handcuffs with such double locking mechanisms have the disadvantage that a key can be easily obtained, formed and/or copied.

Other prior art handcuffs and leg irons achieve the second double lock mechanism through the use of a separate auxiliary locking mechanism. This separate auxiliary mechanism is typically engaged via a slot or hole either on the side of the handcuff locking body, or on the cheek plate. This makes it somewhat inconvenient for the police officer or other user to use the handcuffs. U.S. Pat. No. 4,574,600 to Moffett shows an auxiliary mechanism on the reverse side of, or at least spaced apart from, the keyway for engaging the first locking position. In this patent, one end of the key is inserted into the keyway for engaging the first locking position, and the other end of the key is inserted into the slot or hole of the auxiliary mechanism for engaging the second locking position. It is believed to be somewhat cumbersome to engage the double locking mechanism of this patent.

Thompson U.S. Pat. No. 5,007,257 shows a device that attaches to a set of chain-linked handcuffs to block access to the original key hole as manufactured as well as to provide protection and rigidity to the chain via a hinged box that sandwiches the handcuff chain and a portion of the body. Although this device is an accessory that attaches to the handcuffs, it does not alter the key in any way. It merely covers the keyhole from access. In addition, it also provides a slot for a chain to feed through and then be pad-locked in order to maintain the prisoner's wrist close to his waist.

Rosenthal U.S. Pat. No. 3,616,665 is similar to that of Thompson U.S. Pat. No. 5,007,257. The significant difference is that Rosenthal allows access to the original manufacturer's keyhole and Thompson does not. Although this is an accessory to handcuffs and leg irons, neither Thompson's nor Rosenthal's devices alters the original key.

BRIEF DESCRIPTION OF THE INVENTION

The present invention relates to a high security-restricted key device that can be attached to handcuffs and leg irons. The accessory (hereafter "Retrofit Kit"), after it is attached, converts the existing keys used on the existing device to a different key.

The Retrofit Kit attaches to an existing set of handcuffs and leg irons by means of a front and back plate that creates a sandwich in which the body lock-housing portion of a handcuff and leg iron is captured between the front and back plates.

Attached to the front plate of the Retrofit Kit is a multiple tumbler lock cylinder capable of many key combinations and which also utilizes a restricted access key. This cylinder is connected to an altered form of the original key. This altered form of the original key serves as a driver for the existing lock mechanism of the handcuff. Once the Retrofit Kit is attached to the handcuffs or leg irons the original key, whether unique to the set or a universal key, will no longer be capable of being inserted into the handcuffs or leg irons for use in opening them. Only the new, restricted access key for the tumbler lock can be used to open the handcuffs and leg irons.

The Retrofit Kit illustratively is made from plastic, metal or any other suitable material. Once seated, the front and back plates of the Retrofit Kit are secured together using screws, rivets, adhesives or any other material or process, such as welding, designed for connecting one component to another, thereby creating one complete integral unit.

The double lock portion of the handcuff or leg iron is accessed via a hole in the side or a slot in the rear of the Retrofit Kit. This hole or slot is located directly on top of the original hole or slot in the existing handcuff or leg irons as designed by the original manufacturer to engage the double lock portion of the handcuffs or leg irons.

In order to engage the double lock portion of the handcuffs or leg irons, there is provided either a key fob or a cover on the key with a pin protruding from the tip that can be inserted into the hole or slot on the Retrofit Kit. This pin is long enough to access the original manufacturer's mechanism in order to engage the double lock.

As a further feature of the Retrofit Kit, there is a triple lock design that provides an extra level of security for keeping the handcuffs or leg irons locked in a stable position, thereby preventing the single strand (swing arm) from moving in either direction. To engage the triple lock portion of the Retrofit Kit, an additional broached slot is provided on the interior of the Retrofit Kit cylinder lock barrel that allows for the locking portion of the cylinder to rotate into this position. The triple lock position of the Retrofit Kit is the same as the double lock position shown in the prior U.S. Pat. No. 5,797,284 to Lurie. Rotating the cylinder of the Retrofit Kit into this position, the driver is now placed in a position pressing down on the interior catch of the handcuffs thereby not allowing the catch to move up far enough. By restricting the movement of the interior catch, the handcuffs and leg irons cannot allow the handcuff locking arm to cycle through from position to position.

In order to disengage the triple lock, the key needs to be rotated to its original, "ready to lock" position. This moves the driver to a position that does not affect the interior catch from moving up and down as the handcuff locking arm cycles from position to position.

OBJECT OF THE INVENTION

An object of the present invention is to provide a Retrofit Kit for altering an existing set of handcuffs and leg irons, either temporally or permanently, to provide a high security, restricted access key system, to replace the existing, low security key mechanism.

Another object is to provide a handcuff and leg iron locking mechanism that is more difficult to pick than locking mechanisms using a universal key.

A further object is to provide handcuffs and leg irons with a locking mechanism that affords the ability to triple lock, if desired, and which prevents loosening and tightening of the handcuffs and leg irons.

Another object is to provide existing handcuffs and leg irons with a locking mechanism that allows for double locking that is accessible and activatable via the same keyway and with the same key used to access and activate the first locking mechanism (which places the handcuffs in the ready to lock position).

An additional object is to provide a locking mechanism that can be retrofitted to existing handcuffs and leg irons without damaging or permanently changing the existing handcuffs or leg irons.

BRIEF DESCRIPTION OF THE DRAWINGS

Other objects and advantages of the present invention will become more apparent upon reference to the following specification and annexed drawings, in which.

DETAILED DESCRIPTION OF THE INVENTION

Figure 1:
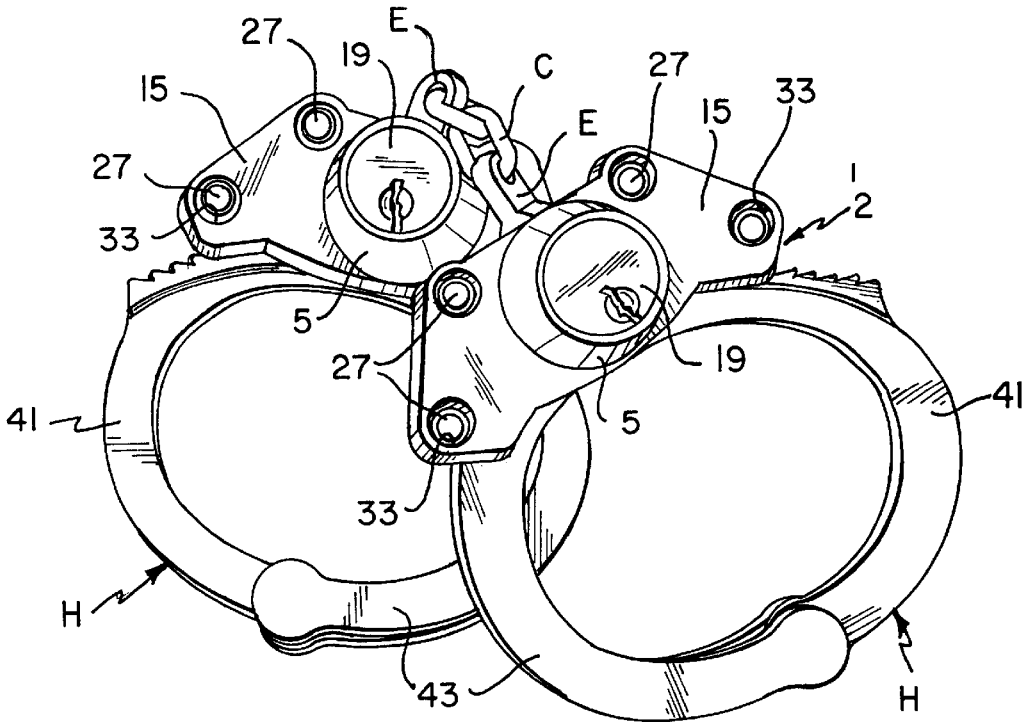
FIG. 1 is a front perspective view of a set of handcuffs with the Retrofit Kit of the present invention installed.

A removable retrofit device 2 in accordance with the principles of the present invention is shown in FIG. 1 attached to the body of each handcuff H of a set. A chain C from eyelet E on each handcuff H connects the two. The retrofit device 2 attached to each handcuff H of a standard set is substantially identical and only one retrofit device is described in detail, the description of one retrofit device being applicable to the description of the other device. The description is made relative to a handcuff but also applies to a leg iron.

Figure 2:
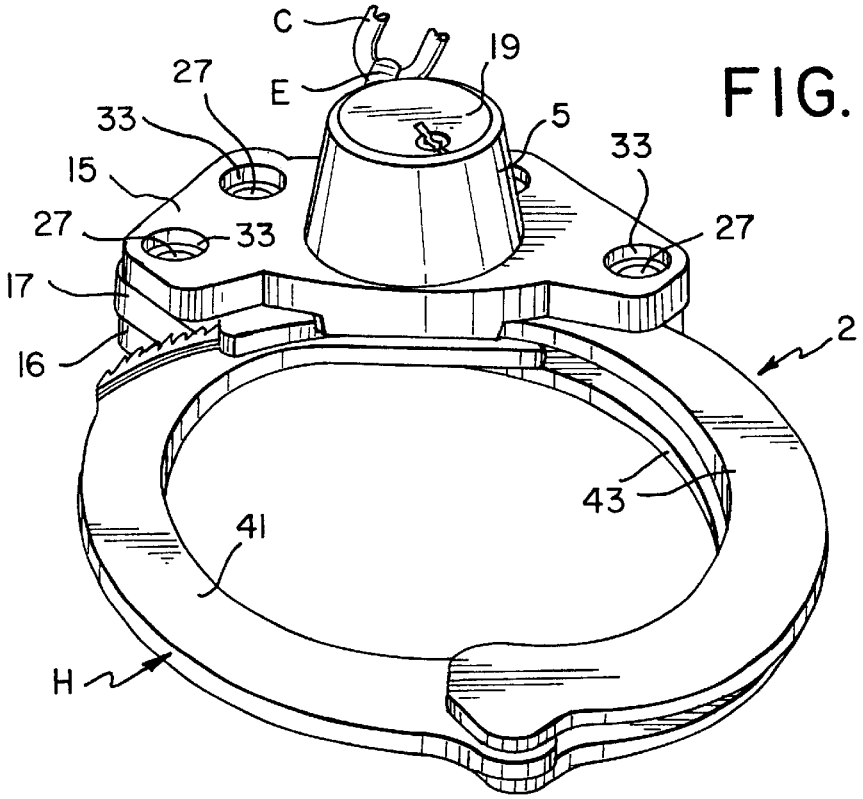
FIG. 2 is a front perspective view of a handcuff with the Retrofit Kit installed showing how the retrofit wraps underneath the body of the handcuffs.

As shown in FIG. 2, each retrofit device has a top plate 15 and a bottom plate 16 each having a shape that fits snugly over the central body 17 of a standard handcuff H in order to sandwich the body between the two plates. The handcuff body 17 houses the original locking system of the handcuff.

The retrofit device top plate 15 has a lock cylinder shell 5 protruding from the surface which houses a lock cylinder 19. The lock cylinder 19 is held to the top plate 15 by a driver washer 12 that is secured on to the rear of the lock cylinder 19 with two screws 14 that pass through the holes in the driver washer 12 (FIG. 3) effectively sandwiching the top plate 15 in between lock cylinder 19 and driver washer 12.

Figure 3:
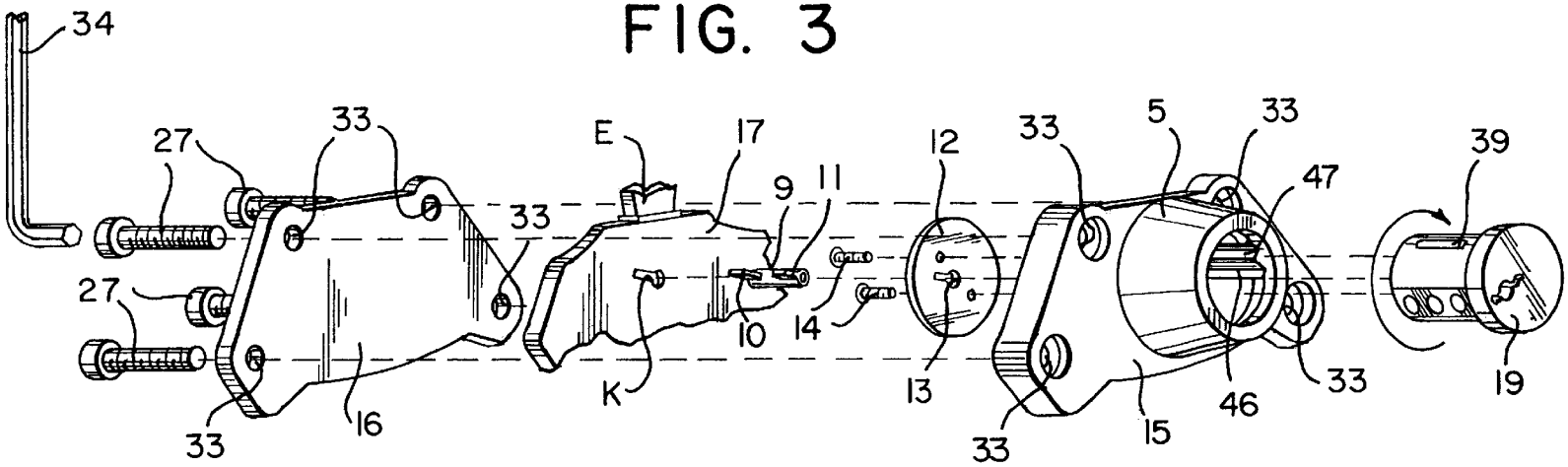
FIG. 3 is an exploded internal view of the Retrofit Kit showing how the driver washer containing a key hole shaped hole engages the driver.
Figure 3A:
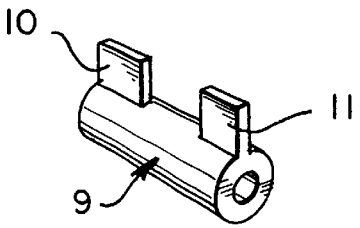
FIG. 3A is a perspective view of the driver.
Figure 4:
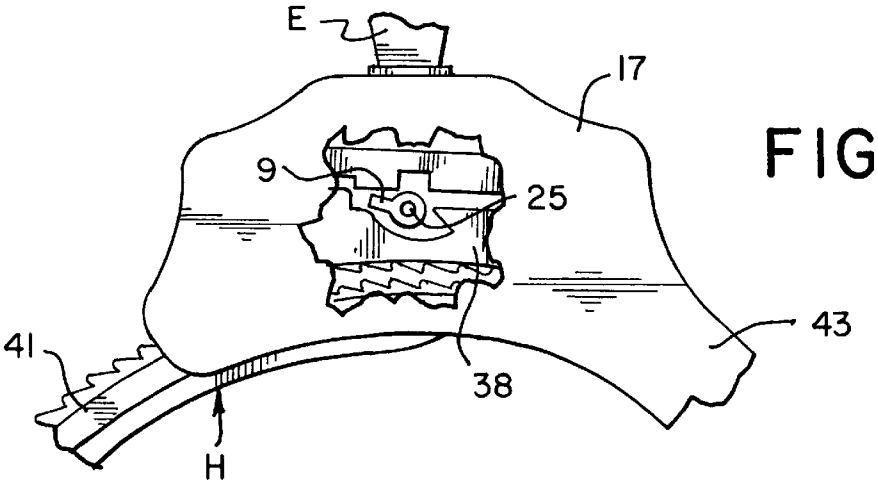
FIG. 4 is a view of the Driver Key of the present invention installed in an open view key way of an existing handcuff. In this view, the Driver Key is in the neutral, "ready to lock" position.
Figure 5:
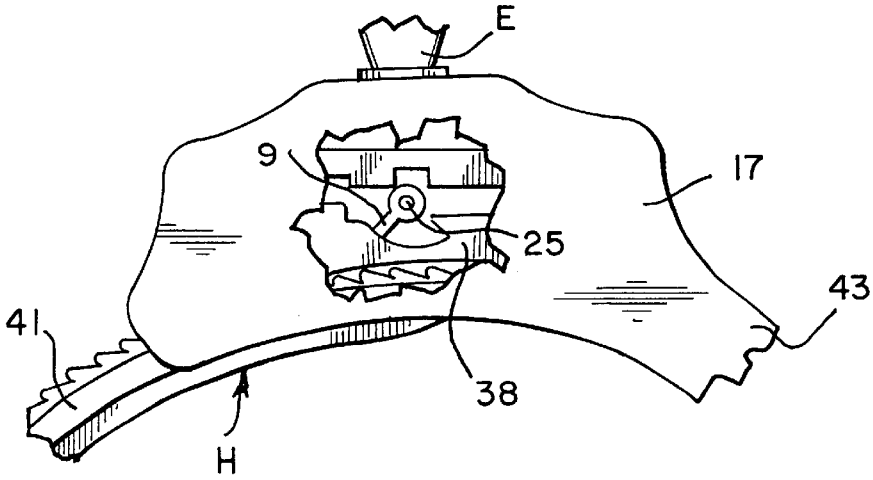
FIG. 5 is a view similar to FIG. 4 in which the driver is rotated approximately 45 degrees counter clockwise to the neutral, "ready to lock" position of FIG. 4, to engage the triple lock feature.
Figure 6:
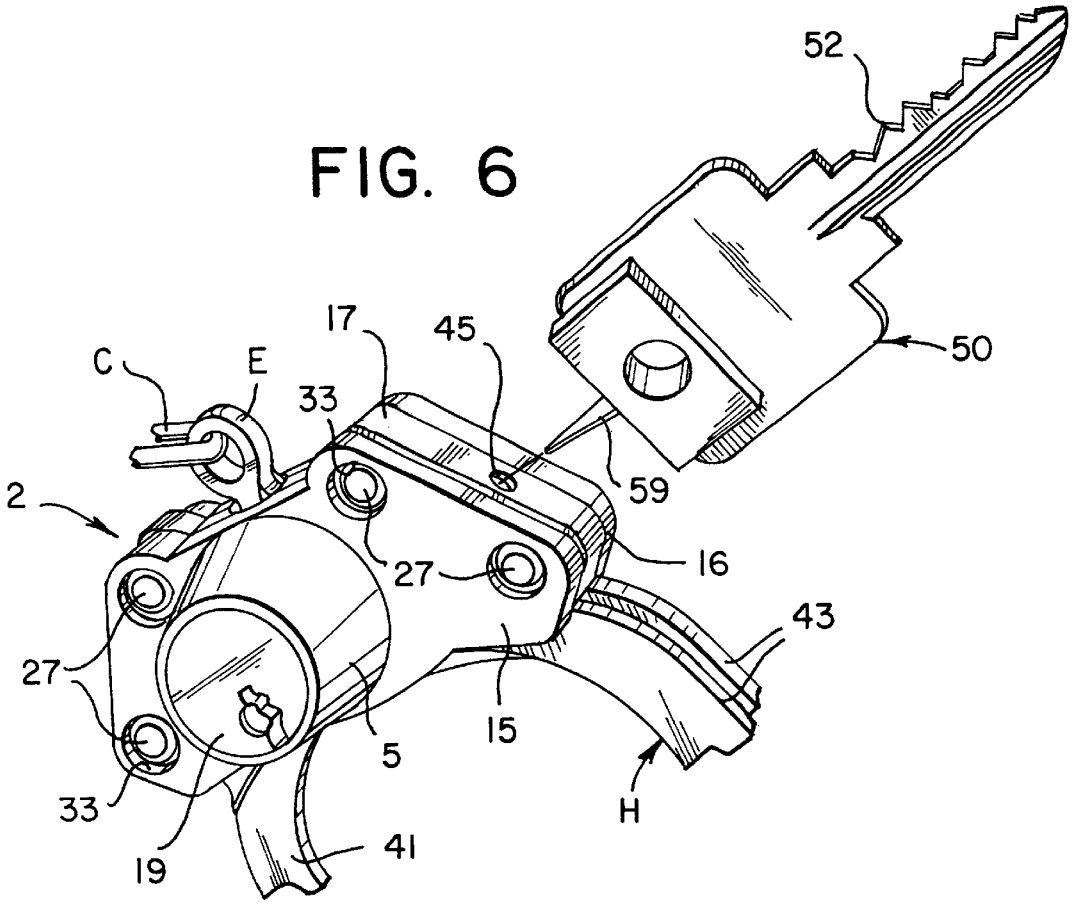
FIG. 6 is a perspective view of the device installed on a handcuff view the original double lock feature of the existing handcuffs about to be engaged via inserting the point of a key with an access hole.

A driver key 9 (FIG. 3A) has one end 10 placed on the post 25 in the key hole K of the existing handcuff H, as can be seen in FIGS. 4 and 5. The driver end 10 corresponds to the key that would normally actuate the handcuff lock system. The other end 11 of the driver 9 is configured to fit into the keyhole 13 of the retrofit driver washer 12, as can be seen in FIG. 3, as the device top plate 15 is placed over the handcuff body 17. Rotation of the device lock cylinder 19 by the keyed end 52 of a kit required key 50 (FIG. 6) rotates washer 12 which in turn rotates driver 9 to rotate the key post 25 of the original handcuff lock system.

After installing the top plate 15 onto the handcuff, the handcuff H is flipped over to install the retrofit bottom plate 16 onto the rear of the handcuff body 17. The retrofit top plate 15 and bottom plate 16 are secured to the handcuff body 17 such as by high security bolts 27 that are passed through the bolt holes 33 on the retrofit and then tightened with the retrofit installation tool 34. Any other suitable fastening technique can be used such as by welding two metal plates 15–16 or securing two plastic plates 15–16 with an epoxy or by ultrasonic welding.

FIG. 2 shows that the handcuff is able to operate as it did before except that the original key-way K has now been converted to a restricted access, pick resistant lock cylinder 19.

In FIG. 4 the handcuff is shown in the "ready to lock position", whereby the end 10 of the retrofit driver key 9 inserted on the handcuff key hole post 25 is resting in a position that allows the pawl 38 of the handcuff existing lock system to move up and down as the handcuff locking arm ratcheted single strand 41 is cycled through the component housing 17 and the double strand cheeks 43 (see FIGS. 1 and 2). In this state, the key end 52 in the cylinder 19 has turned it to a position where a side bar 39 on the lock cylinder sits in a broached slot 46 on the interior of the lock shell 5 (see FIG. 3).

In order to engage the triple lock feature the standard key end 52 is inserted into the lock cylinder 19, and then rotated to the next broached position 47 of the lock shell, allowing the cylinder side bar 39 to lock into place. The lock cylinder 19 cannot be rotated without the key 52 installed into the keyway because the spring loaded side bar 39 will not press into the lock cylinder 19 without the key end 52 installed. In addition, the key 50 cannot be removed from the lock cylinder keyway while the side bar 39 is depressed. It is for this reason that the broached slots 46 and 47 are used. While the slots 46 and 47 are shown close to each other, they can be up to from about 45° to 90° apart on the internal wall of shell 5.

When the lock cylinder 19 is rotated to the triple locked position, the driver key flag end 10 places pressure on the pawl 38 of the handcuff lock system preventing any upward movement of the handcuff pawl. This triple lock position is shown in FIG. 5.

Therefore, if all locking features are used in conjunction, "ready to lock", handcuff "double lock" and then the retrofit "triple lock" the handcuff or leg iron with the device 2 is in its most secure state.

Access to the double locking feature of the handcuff is still available via a retrofit double lock access hole 45 (FIG. 6) in the device 2 into which a point end 59 on key 50 can fit. The other end 52 of the key 50 has the usual keyed configuration to fit into and operate the lock cylinder 19. The point end 52 is long enough to engage the double lock in the conventional manner.

It should be noted that some handcuffs and leg irons do not use a hole on the side of the handcuff to engage the double lock feature. Instead, a slot is provided on the front plate of the top or bottom plate to access the double lock feature. That is, the access slot would be located in the proper position.

As seen, the retrofit provides a locking mechanism on each handcuff or leg iron that is positioned and oriented to limit access to the keyway. A cylinder lock has a restricted keyway when attached to the handcuff or leg iron that is positioned substantially parallel to the pivot axis of the handcuff or leg iron locking arm and with the plane of the device keyway entry spaced from the plane of the handcuff or leg iron cheek plates.

In use, handcuffs are placed on the prisoner with the keyway of the cylinder 19 facing the upper arms of the prisoner and away from the prisoner's hands. Thus, when the handcuffs are on the prisoner, access to the keyway of the cylinder 19 is severely impeded, especially because of the additional spacing of the keyway from the cheek plates and thus away from the prisoner's hands.

Additionally, the cylinder lock preferably uses a restricted access key. This key is part of a key control program in which the keys cannot be cut on ordinary key cutting machines so that there is exclusive control of key distribution. It is preferred that by agreement, only persons with authorized identification may have additional keys cut and keys are duplicated and supplied only to those people who are pre-authorized to purchase keys cut to the specific code that was assigned to the specific end user. Upon receipt of a first order, a customer completes a form that requires the signature of the authorized purchasing agent. This form is kept on file in the office of the Retrofit Kit manufacturer. All future request for keys cut to the specific key code that was assigned to that end user must contain the signature of the authorized purchasing agent. Without the authorized signature, the order will not be filled.

While the foregoing description of the drawings represent the preferred embodiments of the present invention, it will be understood that various additions, modifications and substitutions may be made without departing from the spirit and scope of the present invention as defined in accompanying claims. In particular, it will be clear that the present invention may be embodied in other specific forms, structures, arrangements, proportions, and with other elements, materials, and components without departing from the spirit or essential characteristics thereof. One skilled in the art will appreciate that the invention may be used with many modifications of structure, arrangement, proportions, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope or the invention being indicated by the appended claims, and not limited to the foregoing description.

What is claimed is:

1. A device that attaches to a handcuff or leg iron having a body that contains an existing locking system that locks a locking arm to the body and which has a keyway to the locking system; said device comprising:

at least one plate attached to the body of the handcuff or leg iron to block the keyway of the existing locking system;

a cylinder lock on said at least one plate having a keyway; and a driver for engaging the existing locking system and a part of the cylinder lock for actuating the existing locking system of the handcuff or leg iron as the cylinder lock is actuated.

2. A device as in claim 1, wherein said cylinder lock comprises a multiple tumbler type lock.

3. A device as in claim 1, wherein said cylinder lock is actuated by a non-universal keyway.

4. A device as in claim 1, wherein the plane of the cylinder lock keyway is raised above the plane of the body of the handcuff or leg iron.

5. A device as in claim 1, wherein said cylinder lock further comprises:

a side bar selectively extendable from the cylinder of said lock;

a shell in which the cylinder rotates having first and second slots into which said side bar selectively extends; and wherein in a first locking position as rotated by the lock cylinder, said side bar is positioned within said first slot in said cylinder lock shell so that said driver locks a pawl of the handcuff locking system with respect to a ratchet to provide a first locking position for the handcuff locking system; and said side bar is positioned within said second slot in said shell so that driver locks the pawl with respect to the ratchet to provide a second locking position for the handcuff locking system.

6. A device as in claim 5, wherein the extension of said side bar from said lock cylinder is controlled by insertion of a key into the keyway of said cylinder lock.

7. A device as in claim 5, wherein said cylinder lock is a multiple tumbler lock.

8. A device as in claim 5, wherein said cylinder lock has a non-universal keyway such that keys fitting said keyway are available only from a restricted source.

9. A device as in claim 5, wherein the cylinder lock is re-keyable such that it can be removed from the retrofit, re-keyed and re-installed.

10. A device as in claim 5, wherein the cylinder lock has a third locking position set by inserting and rotating the same key into the keyway of said cylinder lock.

* * * * *